US009845437B2

(12) United States Patent
Savage et al.

(10) Patent No.: US 9,845,437 B2
(45) Date of Patent: Dec. 19, 2017

(54) SURFACE PASSIVATION METHOD FOR FOULING REDUCTION

(71) Applicant: Ecolab USA Inc., St. Paul, MN (US)

(72) Inventors: Gregory T. Savage, Slidell, LA (US); Christopher A. Russell, Sugar Land, TX (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 15/040,778

(22) Filed: Feb. 10, 2016

(65) Prior Publication Data

US 2016/0237357 A1 Aug. 18, 2016

Related U.S. Application Data

(60) Provisional application No. 62/115,443, filed on Feb. 12, 2015.

(51) Int. Cl.

| | |
|---|---|
| ***C23F 11/00*** | (2006.01) |
| ***C02F 5/02*** | (2006.01) |
| ***C09K 3/00*** | (2006.01) |
| ***C10G 75/04*** | (2006.01) |
| ***C10G 75/02*** | (2006.01) |
| ***C10G 9/16*** | (2006.01) |

(52) U.S. Cl.
CPC ..... *C10G 75/04* (2013.01); *C10G 9/16* (2013.01); *C10G 75/02* (2013.01)

(58) Field of Classification Search
CPC ..... A61L 2/00; C02F 1/00; C23F 11/00
USPC ..... 422/7, 14, 19; 252/175, 387, 389.54
See application file for complete search history.

(56) References Cited

U.S. PATENT DOCUMENTS

| | | | | |
|---|---|---|---|---|
| 3,703,418 | A | 11/1972 | Iijima et al. | |
| 5,000,836 | A * | 3/1991 | Forester | C10G 9/16 208/113 |
| 5,446,229 | A | 8/1995 | Taylor et al. | |
| 8,092,618 | B2 | 1/2012 | Sharpe et al. | |
| 2008/0234868 | A1 | 9/2008 | Osborne | |

OTHER PUBLICATIONS

International Search Report and Written Opinion issued for PCT/US2016/017302, dated Jun. 6, 2016, 11 pages.

Russell, C. A., et al., "Observations from Heavy Residue Pyrolysis: A Novel Method to Characterize Fouling Potential and Assess Antifoulant Additive Performance", Published on Web Sep. 17, 2010, Energy Fuels 2010, 24, 5483-5492.

* cited by examiner

*Primary Examiner* — Monzer R Chorbaji
(74) *Attorney, Agent, or Firm* — Senniger Powers LLP

(57) ABSTRACT

A method of passivating a metal surface of hydrocarbon processing equipment is provided in which a water soluble molybdate compound is introduced into water or steam which is in contact or will come into contact with a metal surface of the hydrocarbon processing equipment to passivate the metal surface to inhibit surface coke formation.

19 Claims, 3 Drawing Sheets

SURFACE PASSIVATION METHOD FOR FOULING REDUCTION

CROSS-REFERENCE TO RELATED APPLICATIONS

This application claims the benefit of U.S. Provisional Patent Application Ser. No. 62/115,443, filed Feb. 12, 2015, the entirety of which is incorporated herein by reference.

FIELD OF THE INVENTION

The present invention generally relates to surface passivation of hydrocarbon processing equipment to reduce fouling of the equipment. More specifically, the methods relate to inhibiting surface coke formation of equipment used in the oil and gas industry such as equipment which comes into contact with an oil or a natural gas.

BACKGROUND OF THE INVENTION

Thermal coke formation accompanies the generation of cracked distillate and often occurs in furnace tubes of visbreakers and delayed cokers and in any location where hydrocarbon-containing feed is maintained at around 350° C. or above for sufficient time. Foulant accumulation may manifest itself as notable changes to process conditions, such as increased pressure drop and hot spot formation because of uneven flow distributions. The onset of coke formation has been investigated for many years. It is generally believed that coke is produced as a direct byproduct of sequential polymerization and condensation reactions from lightest to heaviest fractions (maltenes, asphaltenes, and coke). Furthermore, a period of time prior to coke formation, termed the coke induction period, was identified. It is this phenomenon that permits thermal cracking processes, such as visbreaking, to operate continuously, because operating severity is preferably before the end of the coke induction period, i.e., the time at temperature (severity) that a portion of feed experiences in the furnace is optimized to ensure that coke is not formed.

Surface pre-treatment such as passivation have been demonstrated to be extremely effective at inhibiting the onset of surface coke formation in refinery units such as visbreakers and cokers under thermal cracking conditions. Under current best practice guidelines, passivator technology is applied after routine decoking events to maximize the reaction with the process surface. The passivation chemistry reacts with the metal surface. More specifically, iron reacts with the passivation chemistry and smooths the surfaces within the processing equipment.

There are three main methods employed by engineers to decoke process surfaces on thermal conversion units or other heat transfer equipment—mechanical pigging, steam/air burning, and online spalling. Sometimes the most efficient process, or the process which removes most of the surface coke, has been shown to be mechanical pigging. In this method, a sponge-like material having metal studs is used in break up the coke in the presence of water. The process is typically performed semi-annually. Generally, it is after this process that current passivation procedures are thought to be most effective. However, the pigging technique requires that the whole of the heater be taken out of service, which therefore dictates a more stringent event timetable that is often at odds with coking events during normal service.

Steam/air burning uses a circulating mass of steam and air to burn coke from process surfaces. This process is generally used semi-annually. However, the method also requires that the heater be taken out of service for at least two or three days, presenting similar engineering problems and economic issues as for mechanical pigging.

The online spalling technique is unique in that the heater may remain in service during the decoking procedure, as one furnace pass at a time is treated. Essentially, the tubes are thermally shocked using a relatively cooler liquid (e.g. water) to break or flake off the coke as the metal process equipment contracts under thermal shock. Although this method is considered in general to be the least effective, recent evidence from customer sites indicate that most of the surface coke is in fact removed, with target "clean" furnace tube temperatures achieved. The key advantage of this technique is that it may be applied anytime there is an observed fouling problem, thus providing relatively more operational flexibility. The technique of online spalling allows thermal conversion unit operators to comply with refinery wide shut down and turnaround schedules.

Treatments to remove surface coke can reduce the useful life of processing equipment so it is better to passivate the surfaces to minimize coke formation. Phosphoric acid esters with or without tert-alkyl amines are conventionally used after mechanical pigging or steam/air burning. This treatment is added when the hydrocarbons being processed are introduced into the equipment after decoking as the equipment is being brought back online. Disadvantages associated with the use of phosphoric acid ester passivation chemistries include the corrosivity of phosphorus at high temperatures encountered in hydrocarbon processing equipment, the potential for loss of primary containment, and the potential for phosphorus to foul crude distillation towers requiring premature shut down and tray replacement, or to poison hydrotreater catalysts.

It would be beneficial to provide a passivation technology that is compatible with online spalling or other decoking processes, providing an extended time period between decoking events, which would ultimately improve throughput and conversion.

SUMMARY OF THE INVENTION

A method of passivating a metal surface of hydrocarbon processing equipment is provided. The method comprises introducing a water soluble molybdate compound into water or steam which is in contact or will come into contact with a metal surface of hydrocarbon processing equipment to passivate the metal surface to inhibit surface coke formation.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
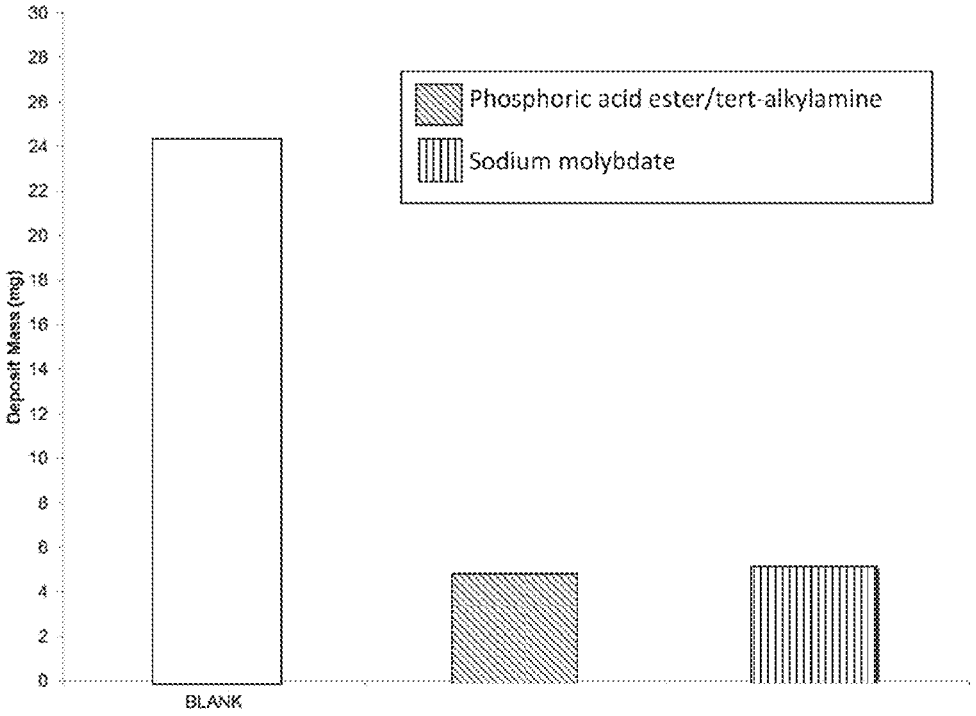
FIG. 1 is a bar graph which depicts the effect of surface passivation on coke deposition mass when treated with a phosphoric acid ester/tert-alkylamine, sodium molybdate, or untreated control.

The passivation methods described herein apply a robust chemical film or layer to metal process surfaces in fired heaters or other high temperature thermal conversion, distillation refinery, or petrochemical plant equipment. Since the chemical film or layer can be formed under aqueous conditions from relatively low to ambient or even high temperatures, it can be applied at stages during operation (e.g., online spall) that otherwise would not be possible using conventional approaches.

A method of passivating a metal surface of hydrocarbon processing equipment is provided. The method comprises introducing a water soluble molybdate compound into water or steam which is in contact or will come into contact with a metal surface of hydrocarbon processing equipment to passivate the metal surface to inhibit surface coke formation.

As a result of the method, corrosion or fouling of the metal surface can be inhibited as compared to the same metal surface under the same conditions without the passivation.

As a result of the method, induction time before coking occurs on the metal surface of the hydrocarbon processing equipment is increased as compared to the same metal surface under the same conditions without the passivation. For example, the induction period before coking occurs can be two fold that of the same metal surface under the same conditions without the passivation.

The passivation achieved using the method is about the same or better than the passivation obtained using a phosphate ester for passivation at the same temperature for the same length of time. Unlike the phosphate ester passivation chemistry, the molybdate compound does not poison the hydrotreater catalysts, is not corrosive, and does not pose the risk of loss of primary containment.

The molybdate compound reacts with the metal surface of the hydrocarbon processing equipment to coat the metal surface, reducing interactions between the metal surface and hydrocarbon processed in the equipment. Foulants such as coke do not adhere well to the coating, minimizing formation of obstructions or blockages in the processing equipment.

The molybdate compound can comprise an alkali metal molybdate (e.g., sodium molybdate or potassium molybdate), an alkaline earth metal molybdate (e.g., magnesium molybdate), ammonium molybdate, molybdic acid, or cerous molybdate. Preferably, the molybdate compound comprises sodium molybdate.

The molybdate compound can be anhydrous or can be a hydrate form such as sodium molybdate dihydrate ($Na_2MoO_4.2H_2O$).

The molybdate compound can be added to the water or steam in a concentration of about 10 to about 25,000 ppm, preferably about 100 to about 5,000 ppm, and more preferably from about 500 to about 2,500 ppm.

If the molybdate compound is introduced as part of a composition, the composition is preferably free of any source of phosphorus such as phosphoric acid or phosphates.

The molybdate compound can be introduced during or after an online spalling, mechanical pigging, or steam/air burning process. Preferably, the molybdate compound is introduced during an online spalling such as toward the end of an online spalling process.

The molybdate compound can be added and the passivation can occur without shutting down the hydrocarbon processing equipment.

The hydrocarbon processing equipment can be any equipment used to refine, store, transport, fractionate, or otherwise process a hydrocarbon such as crude oil, natural gas, petroleum, and petroleum fractions including residues.

The hydrocarbon processing equipment can comprise a thermal conversion unit, a heat exchanger, a visbreaker, a coker, a fired heater, a fractionator, a tube, a pipe, a tank, a reactor, or other heat transfer equipment.

The molybdate compound can be introduced into a water tank connected to a feed inlet of the hydrocarbon processing equipment.

The molybdate compound can be introduced directly into a water or steam inlet of the hydrocarbon processing equipment.

The hydrocarbon processing equipment can be part of a refinery or petrochemical plant.

The hydrocarbon processing equipment is not an engine, hydraulic brake, power steering system, or transmission wherein molybdate may be used as a coolant additive in hydraulic fluid.

The temperature in the hydrocarbon processing equipment typically ranges from about 15° C. to about 650° C. during the passivation, preferably from about 100° C. to about 600° C., and more preferably from about 150° C. to about 550° C.

Having described the invention in detail, it will be apparent that modifications and variations are possible without departing from the scope of the invention defined in the appended claims.

EXAMPLES

The following non-limiting examples are provided to further illustrate the present invention.

Laboratory testing incorporates the use of a pyrolysis apparatus that simulates process conditions and temperatures as described by Russell et al., *Energy Fuels,* 24:5483-5492 (2010), which is incorporated herein by reference. One of the more unique aspects of the equipment is the ability to accurately measure surface coke formed during the cracking of heavy resid.

In FIG. 1, the first bar on the chart represents a level of surface coke deposited during the pyrolysis of a particular vacuum residue coker feed, a value referred to as the Blank (untreated) experiment.

Next, a conventional passivation procedure was performed in the laboratory by submersing the reactor inserts in hydrotreated mineral oil, and heating to a temperature of 250° C. At this point, the passivation additive was added at a concentration of 1000 ppm, and left to react for one hour. This laboratory methodology simulates the process on a real unit, where the passivator would be applied over a very short time frame (12 to 24 hours) at a high concentration (at least 1000 ppm) in a hydrocarbon medium during the warm up of the furnace to bring it back online. In the laboratory procedure, the reactor insert was ready for pyrolysis once the residual mineral oil was removed. A typical result from a passivated insert is represented by the second bar in the FIG. 1. For this particular resid composition, a phosphoric acid ester/tert-alkyl amine passivation is successful, with an 80% reduction in coke relative to the blank. However, this method of passivator application may not be applicable at an appropriate time, such as during an online spalling event.

The method of the invention was simulated in the laboratory by submerging clean reactor inserts into water, and heating to 95° C., at which point, sodium molybdate, a water soluble molybdate compound, was added at a concentration of 2000 ppm, and left for one hour. Once dried, the insert was pyrolyzed in the presence of the same resid. The result in terms of surface deposit is represented as the last bar in FIG. 1. Significantly, the water soluble molybdate compound performed similarly to the conventional phosphoric acid ester/tert-alkylamine approach, with an 80% reduction in surface deposit.

Figure 2:
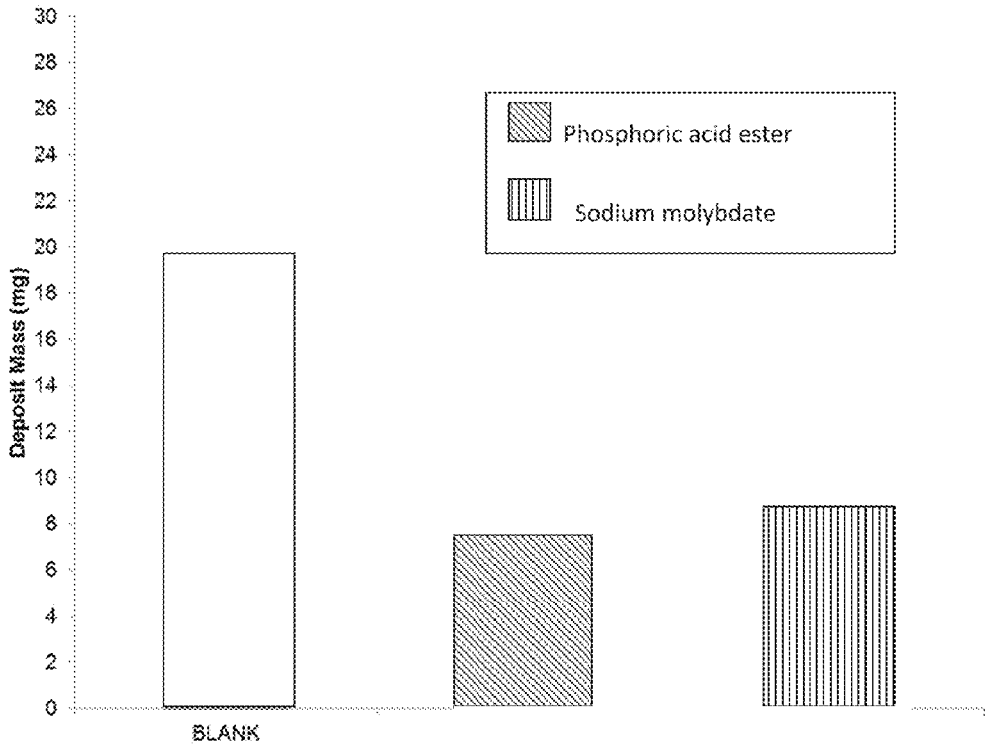
FIG. 2 is a bar graph which depicts the effect of surface passivation on coke deposition mass when treated with a phosphoric acid ester, sodium molybdate, or untreated control.

A further exemplar vacuum residue is shown in FIG. 2, which is the feedstock for a European-based visbreaker. Here, the conventional passivation additive chemistry was a phosphoric acid ester, which as above, may only be applied during heater warm up in a hydrocarbon medium. The performance of the sodium molybdate passivation is displayed as the last bar, and as with the coker feedstock, there is similar surface coke reduction performance as with the phosphoric acid ester.

Figure 3:
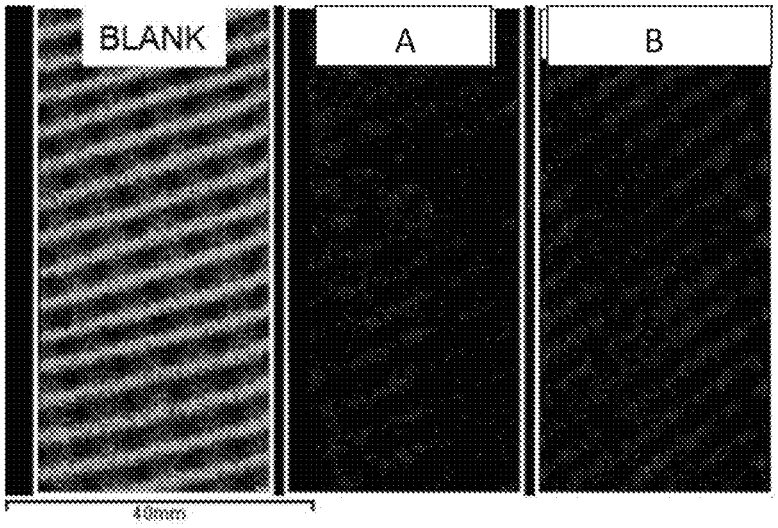
FIG. 3 shows the sulfur signature on x-ray micrographs of passivated reactor surfaces post pyrolysis when treated with a phosphoric acid ester/tert-alkylamine, sodium molybdate, or untreated control.

The comparison in performance for the coker feedstock vacuum residue was investigated further by examining the surface chemical composition of the post pyrolysis inserts from FIG. 1 using x-ray microscopy. The photo-micrographs are displayed in FIG. 3. The green signature color represents the element sulfur, which is a ubiquitous constituent throughout coke deposits. Therefore, the more prominent the green color, the more prominent the coke deposit. For the Blank sample, the outline structure of the woven mesh reactor insert is clearly distinguished by the vivid green signature of sulfur. For the two reactor inserts that were treated with phosphoric acid ester/tert-alkylamine (A) and sodium molybdate (B), respectively, there is almost no sulfur signature, indicating that the amount of coke on the surface was very low, correlating to the dramatic mass loss demonstrated in FIG. 1.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and compositions without departing from the scope of the invention, it is intended that all matter contained in the above description and shown in the accompanying drawings shall be interpreted as illustrative and not in a limiting sense.

What is claimed is:

1. A method of passivating a metal surface of hydrocarbon processing equipment, the method comprising:

removing coke from a metal surface of hydrocarbon processing equipment during a decoking process while the hydrocarbon processing equipment is shut down; and introducing a water soluble molybdate compound into water or steam which is in contact or will come into contact with the metal surface of the hydrocarbon processing equipment to passivate the metal surface while the hydrocarbon processing equipment is shut down, wherein the temperature in the hydrocarbon processing equipment ranges from about 15° C. to about 650° C. during passivation.

2. The method of claim 1, wherein the molybdate compound comprises an alkali metal molybdate, an alkaline earth metal molybdate, ammonium molybdate, molybdic acid, or cerous molybdate.

3. The method of claim 2, wherein the alkali metal molybdate comprises sodium molybdate or potassium molybdate.

4. The method of claim 3 wherein the alkali metal molybdate comprises sodium molybdate.

5. The method of claim 2, wherein the alkaline earth metal molybdate comprises magnesium molybdate.

6. The method of claim 1, wherein the molybdate compound is added to the water or steam in a concentration of about 10 to about 25,000 ppm.

7. The method of claim 1, wherein the molybdate compound is introduced during or after an online spalling, mechanical pigging, or steam/air burning process.

8. The method of claim 7, wherein the molybdate compound is introduced during an online spalling process.

9. The method of claim 7, wherein the molybdate compound is introduced during a mechanical pigging process.

10. The method of claim 7, wherein the molybdate compound is introduced during a steam/air burning process.

11. The method of claim 7, wherein the molybdate compound is introduced after an online spalling process.

12. The method of claim 7, wherein the molybdate compound is introduced after a mechanical pigging process.

13. The method of claim 7, wherein the molybdate compound is introduced after a steam/air burning process.

14. The method of claim 1, wherein the hydrocarbon processing equipment is a pass of a furnace, and the molybdate compound is added and the passivation occurs without shutting down other passes of the furnace or the hydrocarbon processing equipment is part of a refinery or petrochemical plant.

15. The method of claim 1, wherein the hydrocarbon processing equipment comprises a thermal conversion unit, a heat exchanger, a visbreaker, a coker, a fired heater, a fractionator, a tube, a pipe, a tank, or a reactor.

16. The method of claim 1, wherein the molybdate compound is introduced into a water tank connected to a feed inlet of the hydrocarbon processing equipment, or the molybdate compound is introduced into a water or steam inlet of the hydrocarbon processing equipment.

17. The method of claim 1, wherein corrosion or fouling of the metal surface is inhibited as compared to the same metal surface under the same conditions without the passivation.

18. The method of claim 1, wherein induction time before coking occurs on the metal surface of the hydrocarbon processing equipment is increased as compared to the same metal surface under the same conditions without the passivation.

19. The method of claim 1, wherein the passivation is about the same or better than the passivation obtained using a phosphate ester for passivation at the same temperature for the same length of time.

* * * * *